US011248788B2

(12) United States Patent
Putman et al.

(10) Patent No.: US 11,248,788 B2
(45) Date of Patent: Feb. 15, 2022

(54) MODULAR FUEL BURNER ASSEMBLY

(71) Applicant: Astec, Inc., Chattanooga, TN (US)

(72) Inventors: Shannon Putman, Rossville, GA (US); Joseph Unjakoti, Rock Spring, GA (US); Eric Wattenbarger, Attalla, AL (US); Chris McAllister, Ringgold, GA (US); Casey Dillon, Hixson, TN (US)

(73) Assignee: Astec, Inc., Chattanooga, TN (US)

( * ) Notice: Subject to any disclaimer, the term of this patent is extended or adjusted under 35 U.S.C. 154(b) by 224 days.

(21) Appl. No.: 16/582,504

(22) Filed: Sep. 25, 2019

(65) Prior Publication Data

US 2021/0025587 A1 Jan. 28, 2021

Related U.S. Application Data

(60) Provisional application No. 62/877,562, filed on Jul. 23, 2019.

(51) Int. Cl.
*F23D 14/02* (2006.01)
*F23D 14/70* (2006.01)

(52) U.S. Cl.
CPC ..... *F23D 14/70* (2013.01); *F23D 14/02* (2013.01)

(58) Field of Classification Search
CPC ..... F23D 14/70; F23D 14/02
USPC ..... 431/159, 187, 329; 137/509
See application file for complete search history.

(56) References Cited

U.S. PATENT DOCUMENTS

| | | | | |
|---|---|---|---|---|
| 2,007,036 | A * | 7/1935 | Cornell, Jr. | G01F 1/42 138/44 |
| 2,443,071 | A | 6/1948 | Honerkamp et al. | |
| 3,490,858 | A | 1/1970 | Fletcher | |
| 3,637,336 | A * | 1/1972 | Velie | F23D 11/404 431/351 |
| 3,820,943 | A | 6/1974 | De Lancey et al. | |
| 4,096,808 | A * | 6/1978 | Trickel | F23D 17/007 110/102 |
| 4,383,820 | A | 5/1983 | Camacho | |
| 4,422,339 | A * | 12/1983 | Gall | G01F 1/42 138/44 |
| 4,480,988 | A * | 11/1984 | Okabayashi | F24H 1/145 126/92 R |
| 5,839,891 | A | 11/1998 | Cook | |
| 6,857,868 | B1 | 2/2005 | Li et al. | |
| 7,497,772 | B2 | 3/2009 | Laib | |
| 7,874,835 | B2 | 1/2011 | Schwank et al. | |
| 2007/0224556 | A1 | 9/2007 | Springstead | |

(Continued)

OTHER PUBLICATIONS

International Search Report and Written Opinion of counterpart PCT Application No. PCT/US2019/52903 dated Dec. 10, 2019.

*Primary Examiner* — Avinash A Savani
(74) *Attorney, Agent, or Firm* — Chambliss, Bahner & Stophel, P.C.; Stephen D. Adams

(57) ABSTRACT

A burner assembly including a housing and an airflow restrictor plate for selectively restricting an amount of airflow passing out of the housing in order to reduce a heat output of the burner assembly. The housing has an air inlet and an air outlet and is configured to guide an airflow from the air inlet and out of the housing via the air outlet. The airflow restrictor plate has a single opening through which all airflow flowing through the housing from the air inlet must pass in order to exit the housing via the air outlet.

17 Claims, 9 Drawing Sheets

(56) References Cited

U.S. PATENT DOCUMENTS

2009/0241943 A1* 10/2009 Schwank ..... F23D 14/34
126/91 A

* cited by examiner

MODULAR FUEL BURNER ASSEMBLY

CROSS-REFERENCE TO RELATED APPLICATION

This application claims the benefit of U.S. Provisional Patent Application No. 62/877,562, filed on Jul. 23, 2019, and entitled MODULAR FUEL BURNER ASSEMBLY, which is incorporated herein by reference in its entirety.

TECHNICAL FIELD

The invention relates generally to burners. More particularly, the present invention relates to modular gas- and oil-fired burners having adjustable heat outputs.

BACKGROUND OF THE INVENTION

It is known to use a fuel burner assemblies to heat and dry aggregate materials used in connection with the production of hot mix asphalt. However, conventional burner assemblies suffer from several disadvantages. For example, as industrial production needs change, the heat output requirements for existing on-site burners often change as well. Conventionally, such a change would require the purchase of an entirely new burner assembly that was sized appropriately for the new production requirements. Often, modifying the heat output of a burner requires changing or resizing multiple components of the assembly, including fan size and geometry, airflow rate, etc.

It would be desirable, therefore, if the heat output of a fuel burner assembly could be adjusted as needed such that a single burner could be reconfigured with minimal changes to meet various heat output requirements.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "connected" and "interconnected", refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiment thereof, and not to place a limitation on the scope of the invention. Nothing in the specification should be construed as indicating any element as essential to the practice of the invention unless so stated with specificity.

BRIEF SUMMARY OF THE INVENTION

The above and other needs are met by a burner assembly having a housing having an air inlet and an air outlet and configured to guide an airflow from the air inlet and out of the housing via the air outlet. The burner assembly further includes an airflow restrictor plate for selectively restricting an amount of airflow passing out of the housing in order to reduce a heat output of the burner assembly, the airflow restrictor plate having an opening through which airflow must pass in order to exit the housing via the air outlet. In certain preferred embodiments, the burner assembly includes two or more interchangeable airflow restrictor plates. Each of the airflow restrictor plates has openings with different cross-sectional areas such that airflow through the housing may be varied by replacing one of the two or more airflow restrictor plates with another one of the two or more airflow restrictor plates.

In order to facilitate an understanding of the invention, the preferred embodiments of the invention, as well as the best mode known by the inventor for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventor includes all equivalents of the subject matter described herein, as well as various modifications and alternative embodiments such as would ordinarily occur to one skilled in the art to which the invention relates. The inventor expects skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and in which.

DETAILED DESCRIPTION OF THE INVENTION

This description of the preferred embodiments of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness.

Figure 1:
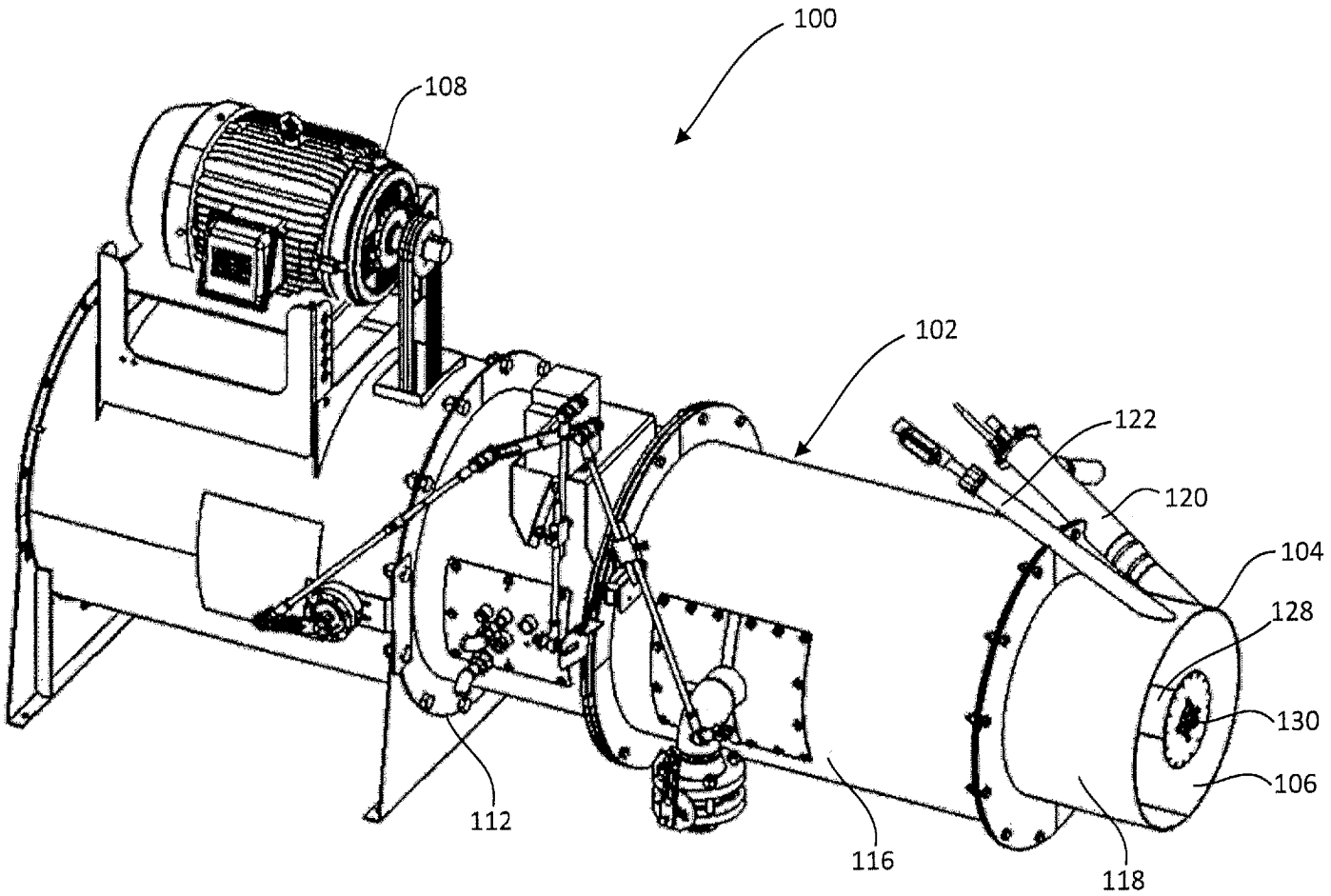
FIG. 1 is a perspective view of a burner assembly according to an embodiment of the present disclosure.
Figure 2:
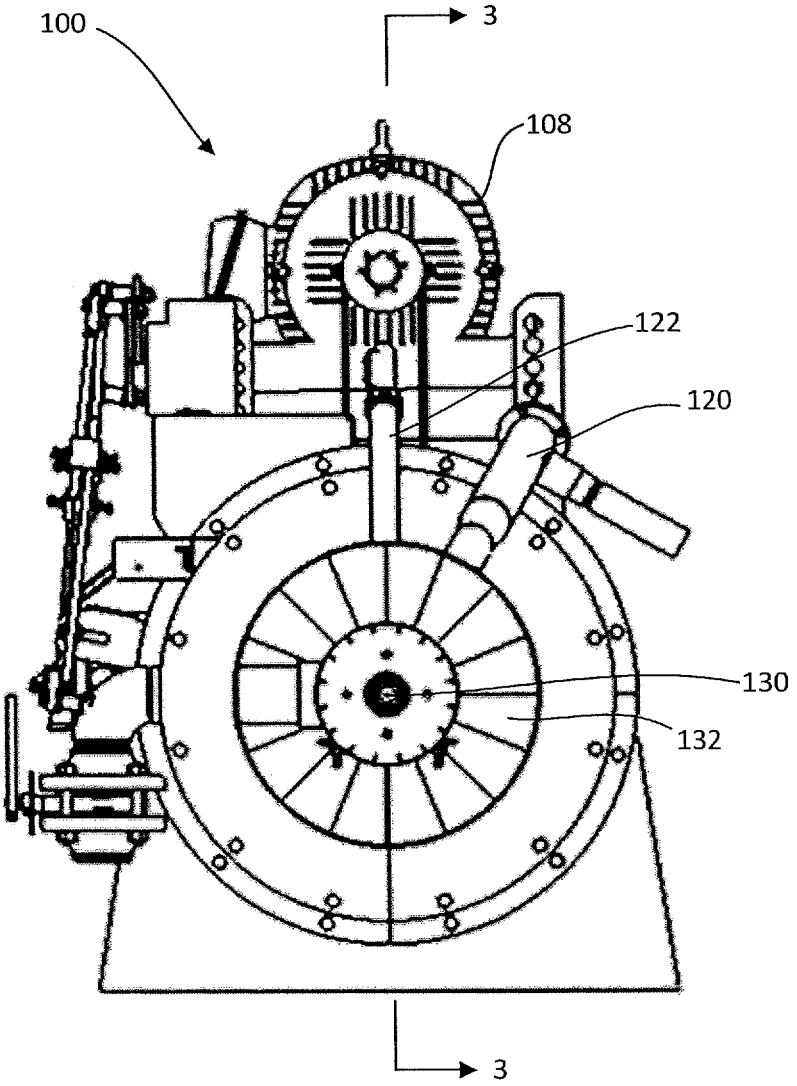
FIG. 2 is a front elevation view of the burner assembly of FIG. 1.
Figure 3:
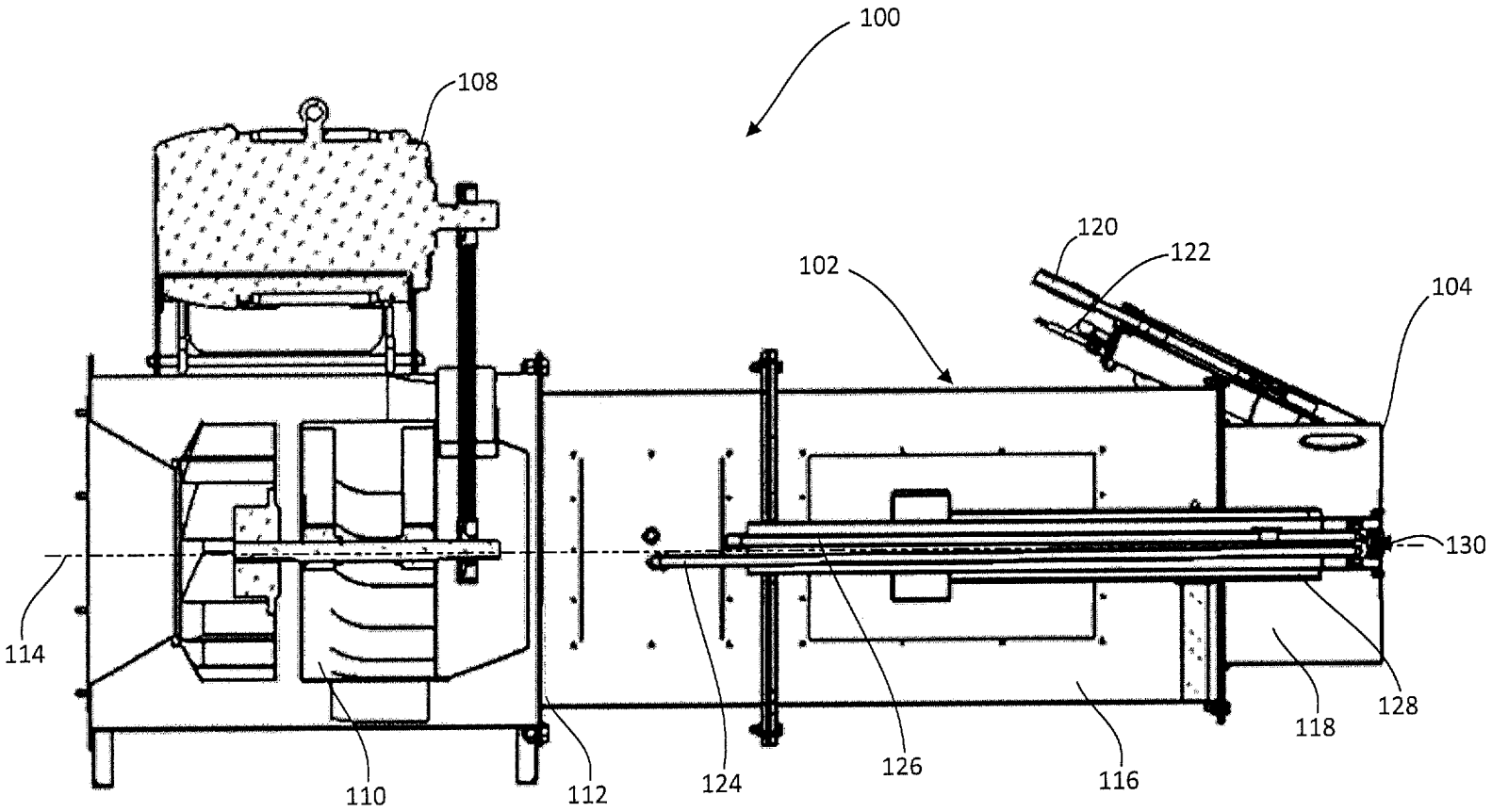
FIG. 3 is a section view of the burner assembly of FIG. 2, taken along line "3-3"

Referring now to FIGS. 1-3, there is provided burner assembly 100 according to an embodiment of the present disclosure. Preferred burner assembly 100 includes housing 102 having air inlet and nozzle end 104 having opening 106 that functions as an air outlet. The preferred burner assembly 100 also includes a motor such as variable speed motor 108 for driving inline centrifugal fan 110 located near fan end 112 of housing 102. Radial damper 132 is located at outlet side of fan 110. Preferred longitudinal axis 114 generally extends from fan end 112 towards nozzle end 104. Preferred housing 102 extends generally along longitudinal axis 114 and includes first tubular housing portion 116 that is located nearest fan 110 and that is removably mounted to second tubular housing portion 118, which is located further downstream from fan 110 than the first housing portion. Gaseous fuel line 120, which includes a gas injection nozzle (not shown), and igniter line 122 each extend along an outer surface of the housing 102. Similarly, liquid fuel guide tube 124 and compressed air tube 126 extend through housing 102 inside of center tube 128 to nozzle end 104 and atomizing nozzle 130.

When the burner assembly 100 is in operation, the fan 110 is configured to create an airflow within the housing 102, which airflow is modulated by the damper 132. The damper 132 includes multiple vanes that can be moved between an open position, where airflow from the fan 110 through the housing 102 is maximized, and a closed position, where airflow from the fan can be minimized or eliminated entirely. The damper 132 also has a number of intermediate positions between the open and closed positions that permit varying amounts of airflow through the housing 102. Typically, the damper is set by selecting one of the several discrete set points that range from fully open and fully closed. For example, a typical damper might have 10 total positions that range from "0" to "9," where position "0" is fully or mostly closed and produces the least amount of airflow and position "9" is fully open and produces the greatest airflow. The airflow created by the fan 110 is carried through the first and second housing portions 116, 118 and exits through the opening 106 at the nozzle end 104, where it is mixed with gaseous fuel and/or liquid fuel. Gaseous fuel is conveyed to the nozzle end 104 via gaseous fuel line 120. Liquid fuel and compressed air are conveyed to the nozzle end 104 inside of the center tube 128 by the liquid fuel guide tube 124 and compressed air tube 126, respectively, where the liquid fuel is atomized by the atomizing nozzle 130. The air and fuel combination is ignited at the nozzle end 104 to create a flame.

Burners, such as burner assembly 100, are often used as part of a large industrial or commercial dryer that is used to dry and process materials, such as aggregate material used in road construction. These dryers typically include large rotary drums that are placed around and extend outwards from the nozzle end 104 of the burner assembly 100. Preferably, the flame produced by the burner assembly 100 extends out through the nozzle end 104 via opening 106 and into the drum to heat and dry the material that is being turned within the drum. Changes to the industrial or commercial processes that require the use of burners typically result in increased heating needs and, therefore, the replacement of a smaller burner with a larger one. For that reason, when initially sizing a burner for a particular application, it would be advantageous to size the burner to provide a heat output that is greater than the heat output that will initially be required by that application. This would allow for the heat output to be increased as the heating needs increased without requiring the burner to be replaced. However, oversizing a burner in this manner can create issues that must be corrected.

First, sizing a burner with the capacity to provide the large amount of fast-moving airflow required to produce high heat output makes adjusting the burner at low airflows more difficult. In particular, if the damper is sized for high amounts of airflow, the damper position required to achieve low airflows is achieved very quickly (e.g., at damper positions "4" or "5"), which limits the adjustability of the burner at low airflow rates. Another issue that may be caused by oversizing a burner is that the flame produced may damage portions of the dryer shell or other surrounding equipment and the temperature of the process and material being heated may be too high. For that reason, the burner assembly 100 of the present invention provides means for increasing and decreasing the heat output of a burner that is also easily adjusted at different airflows.

Figure 5:
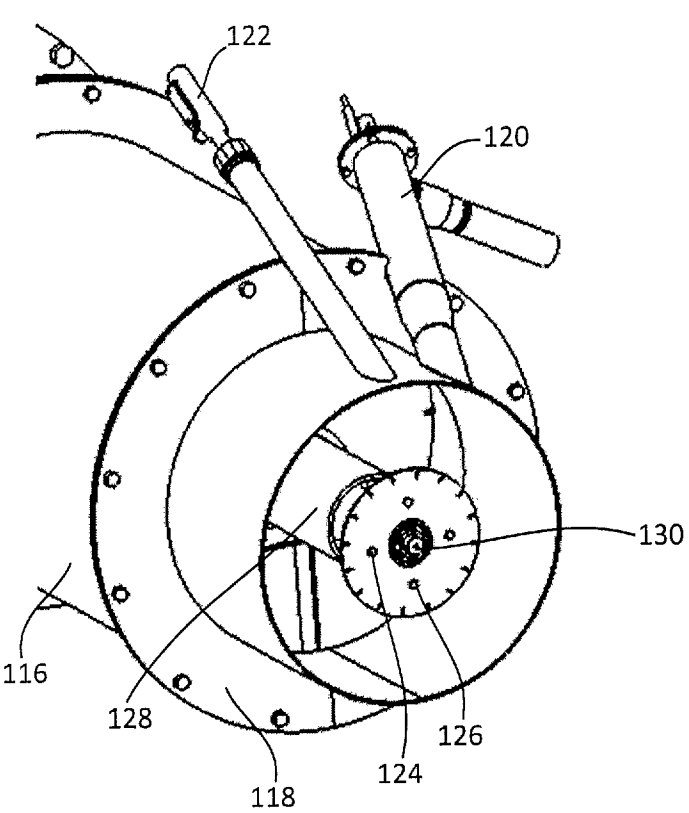
FIGS. 4 and 5 are perspective views depicting a nozzle end of the burner assembly of FIG. 1 with and without an airflow restrictor plate mounted thereon, respectively.
Figure 4:
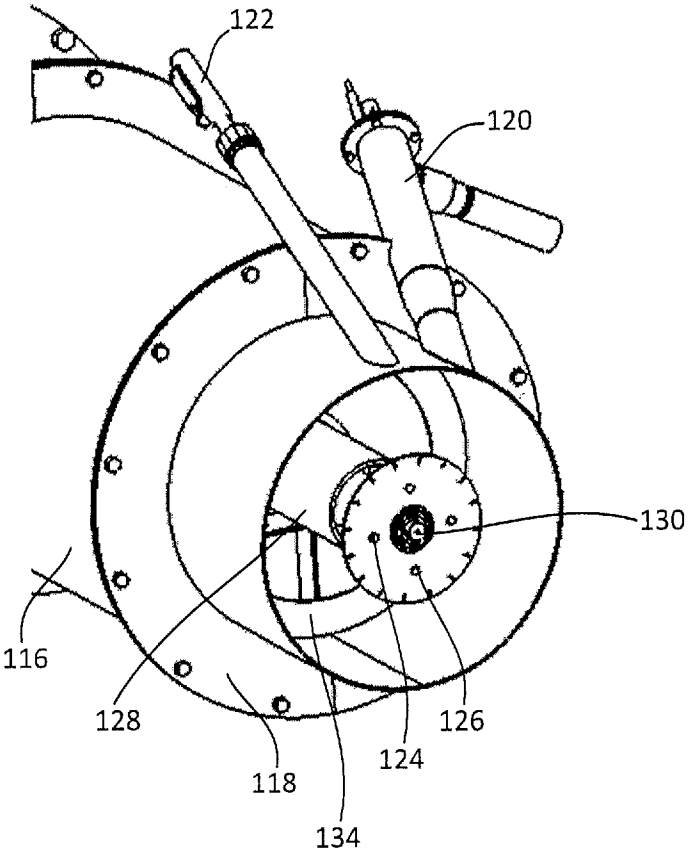

With reference to FIGS. 4-8, the burner assembly of the present invention is provided with an airflow restrictor plate 134 that may be used to selectively restrict airflow through the housing in order to vary the heat output of the burner assembly at the nozzle end. The restrictor plate 134 is placed inside of the housing to restrict a portion of the airflow, as shown in FIG. 4, and to reduce the airflow velocity at the nozzle end of the burner assembly. When more airflow is needed to produce a greater heat output, a less restrictive airflow restrictor plate 134 can be placed into the housing. Eventually, to have maximum airflow and heat output, the restrictor plate 134 can be removed entirely from the burner assembly, as shown in FIG. 5. Thus, an advantage of the restrictor plate 134 of the present design is that heat output can be modified very easily by exchanging a minimal number of components.

In preferred embodiments, the restrictor plate 134 is mounted within the housing 102 between the first housing portion 116 and the second housing portion 118. The restrictor plate 134 is provided with an opening 136 through which airflow must pass in order to pass from the first housing portion 116 to the second housing portion 118 and to exit the housing. Preferably, the perimeter edge of the opening 136 in the restrictor plate 134 is smaller than the inside of the housing 102, including the first housing portion 116 and the second housing portion 118, in order to restrict the air flowing through it. Therefore, preferred restrictor plate 134 redirects (and slows) at least a portion of the airflow away from an inner wall surface of the first housing portion 116, through the opening 136, and into the second housing portion 118.

Figure 6A:
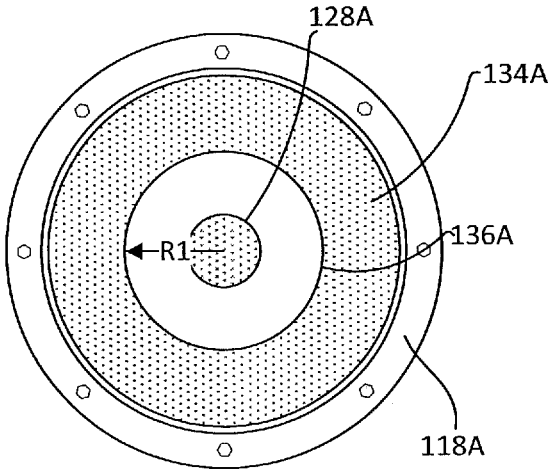
FIGS. 6A-6C illustrate three different burner assembly setups, each with a differently-sized airflow restrictor plate.
Figure 6B:
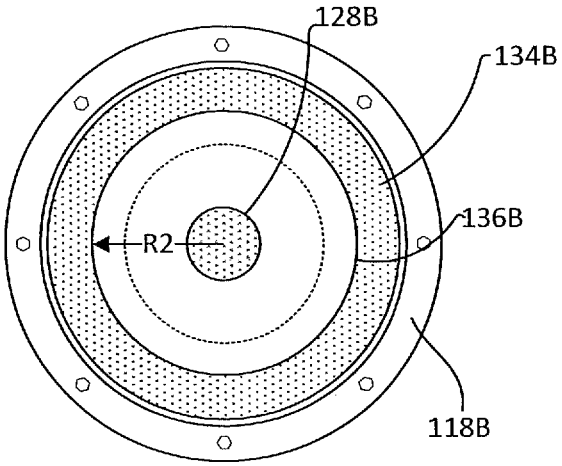
Figure 6C:
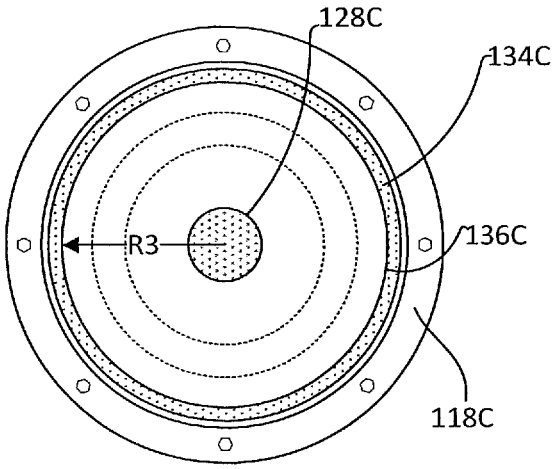

In certain preferred embodiments, the burner assembly 100 includes two or more airflow restrictor plates 134 that are interchangeable with one another. In FIGS. 6A-6C, the nozzle end of a burner assembly having three restrictor plates 134A-C of varying sizes is shown.

The restrictor plate 134A shown in FIG. 6A has an opening 136A with a radius R1 and is the most restrictive of the three (e.g., 25 MMBTU/hr plate). Airflow passes by restrictor plate 134A through the ring-shaped opening 136A that is formed between the restrictor plate and the center tube 128A. A less restrictive restrictor plate 134B having an opening 136B with a radius R2 is shown in FIG. 6B (e.g., 35 MMBTU/hr plate). Lastly, the least restrictive restrictor plate 134C having an opening 136C with a radius R3 is shown in FIG. 6C (e.g., 50 MMBTU/hr plate). Each of the restrictor plates 134A-C can be removed and exchanged as the heat output needs of the burner change. Alternatively, in other embodiments, the size of the opening in the airflow restrictor plate may be selectively adjusted to provide an opening having two or more different cross-sectional areas. For example, instead of using multiple different restrictor plates 134A-C with a fixed opening, a single restrictor plate having a re-sizeable opening (e.g., a mechanical iris) could be used.

Figure 8:
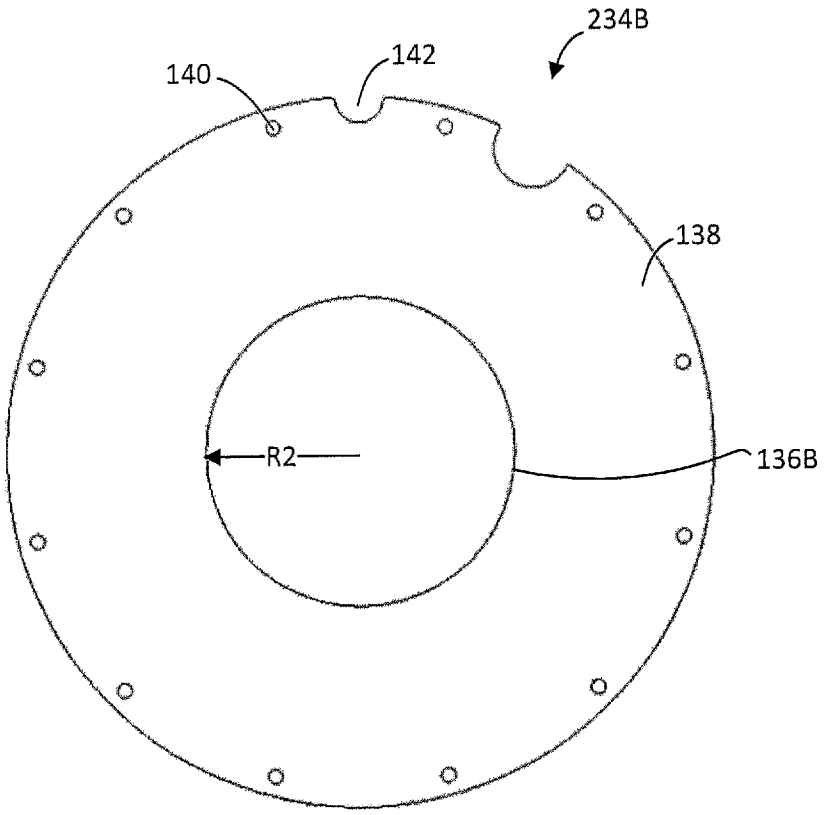
FIGS. 7 and 8 are front elevation views depicting bolt-on airflow restrictor plates having center openings with radii R1 and R2, respectively, for use in a burner assembly according to an embodiment of the present disclosure.
Figure 7:
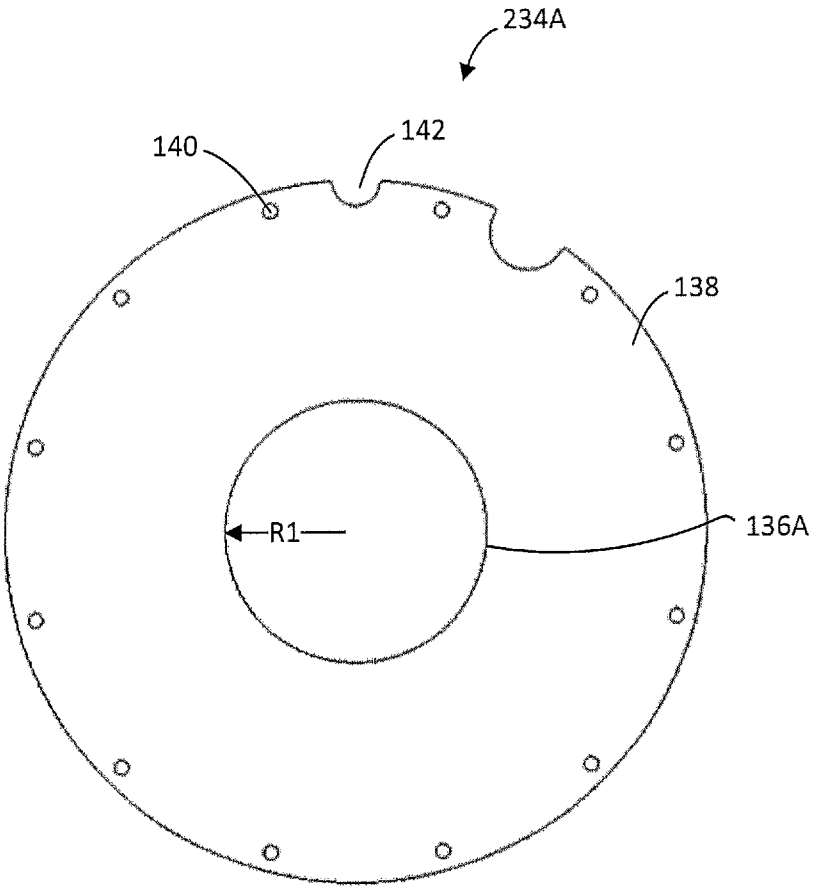

FIGS. 7 and 8 illustrate two restrictor plates 234A, 234B that are each configured to bolt onto the burner assembly shown in FIGS. 4 and 5. Each of the restrictor plates 234A, 234B is provided with a flange 138 that surrounds the opening 136A, 136B which includes a series of fastener openings 140. Additionally, one or more cutouts 142 may be provided to receive the gaseous fuel line 120 and igniter line 122. To removably secure the restrictor plates 234A, 234B to the burner assembly 100, the restrictor plate is placed against an end of the first housing portion 116 and openings 140 in the restrictor plate are aligned with corresponding openings formed in a corresponding flange of the first housing portion. Next, the second housing portion 118 is placed against the restrictor plate 234A, 234B so that the restrictor plate is located between the first housing portion 116 and the second housing portion. Openings formed in a corresponding flange of the second housing portion 118 are aligned with the previously-aligned openings in the restrictor plate 234A, 234B and first housing portion 116. Fasteners are then passed through first housing portion 116, restrictor plate 234A, 234B and second housing portion 118 and are fixed in place with threaded nuts. Lastly, the gaseous fuel line 120 and igniter line 122 are placed into the cutouts 142 and their ends are fitted into the second housing portion 118.

In preferred embodiments, in order to minimize equipment changes as process needs change, a damper having a high airflow capability may be initially selected for the burner assembly. The airflow may initially be adjusted downwards with the damper in order to limit the heat output to the then-required amount of heat. As heating needs increase, the damper may be opened to allow for greater airflow and to increase heat output. However, using a damper that is sized to provide high amounts of airflow in a low airflow situation causes the airflow required for that application to be achieved very quickly. For example, the needed airflow might be reached by position "5" of the damper, which leaves four additional positions (i.e., positions "6" through "9") that are not used. This limits the user's ability to make downward adjustments to the damper to reduce or moderate the airflow.

Figure 9:
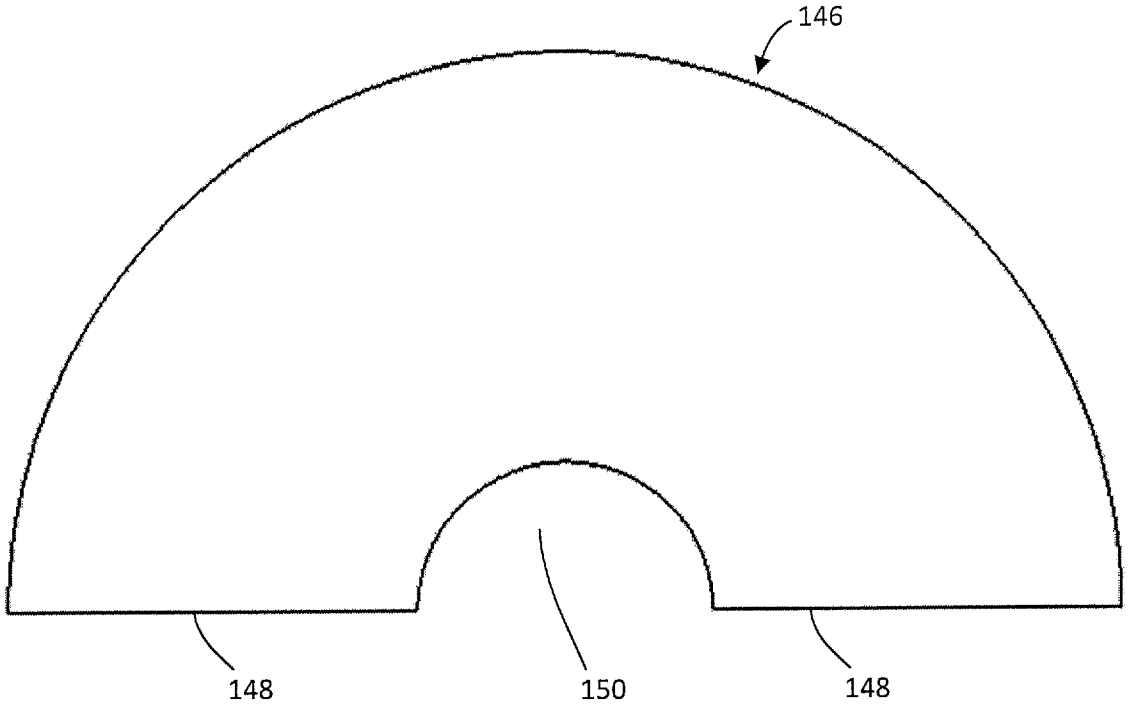
FIG. 9 is a front elevation view depicting a semi-circular fan blocking plate, which may be used to form a circular fan blocking plate according to an embodiment of the present disclosure.
Figure 11:
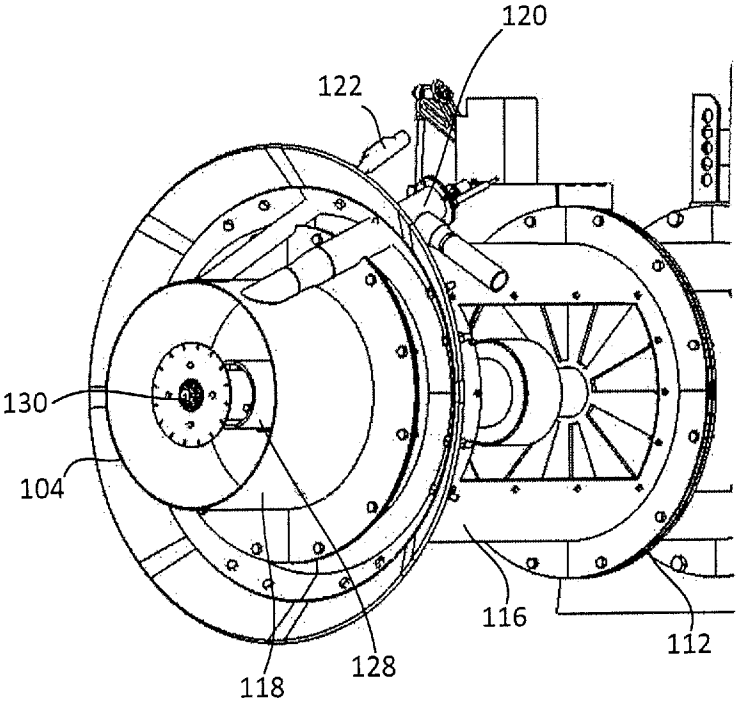
FIG. 11 is a perspective view depicting the burner of FIG. 10 with the fan blocking plate removed.
Figure 10:
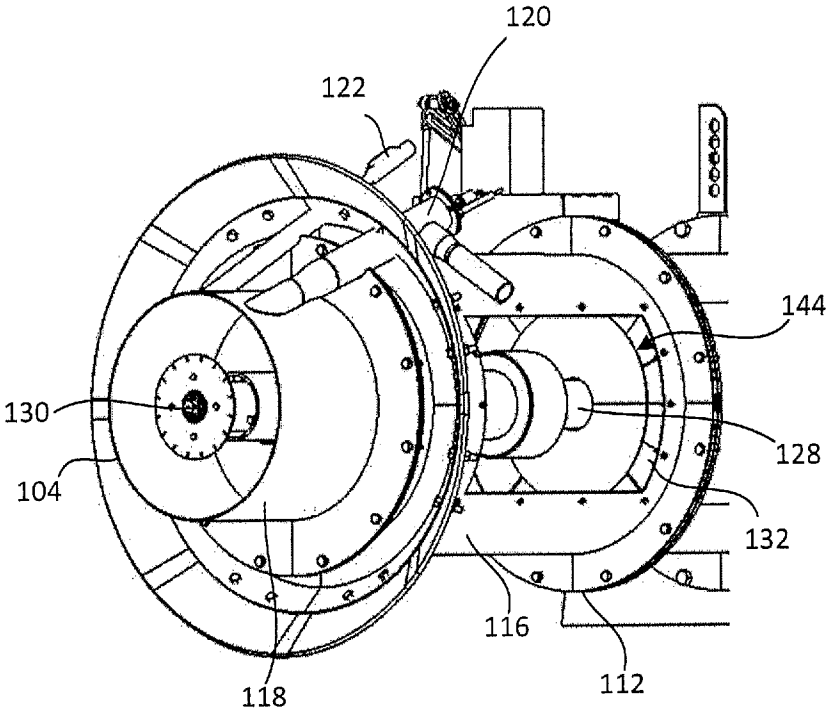
FIG. 10 is a perspective view depicting a internal section of a burner having a circular fan blocking plate mounted adjacent to a fan to restrict airflow according to an embodiment of the present disclosure.

Accordingly, with reference to FIGS. 9-11, preferred embodiments of the burner assembly of the present invention also include removable fan blocking plate 144 that is mounted adjacent the outlet side (downstream) from the damper 132. The fan blocking plate 144 is formed by two semi-circular halves 146. Each half 146 of fan blocking plate 144 has flat side 148 that includes semi-circular cutout 150. When burner assembly 100 is in low airflow mode, one of halves 146 is placed adjacent damper 132 and the cutout is positioned on one side of center tube 128. Next, second half 146 is placed adjacent damper 132 such that flat sides 148 are aligned and cutouts 150 encircle center tube 128 (FIG. 10). Fan blocking plate 144 blocks a portion of damper 132 and reduces the velocity of airflow passing through the damper and housing. Reducing the velocity of the airflow when low airflow is required improves the ability of burner assembly 100 to achieve the desired flow and heat output and increases the adjustability between its maximum and minimum airflow rates. Once airflow needs are increased, fan blocking plate 144 could be removed in order to increase velocity of the airflow and provide a higher heat output (FIG. 11).

Figure 12:
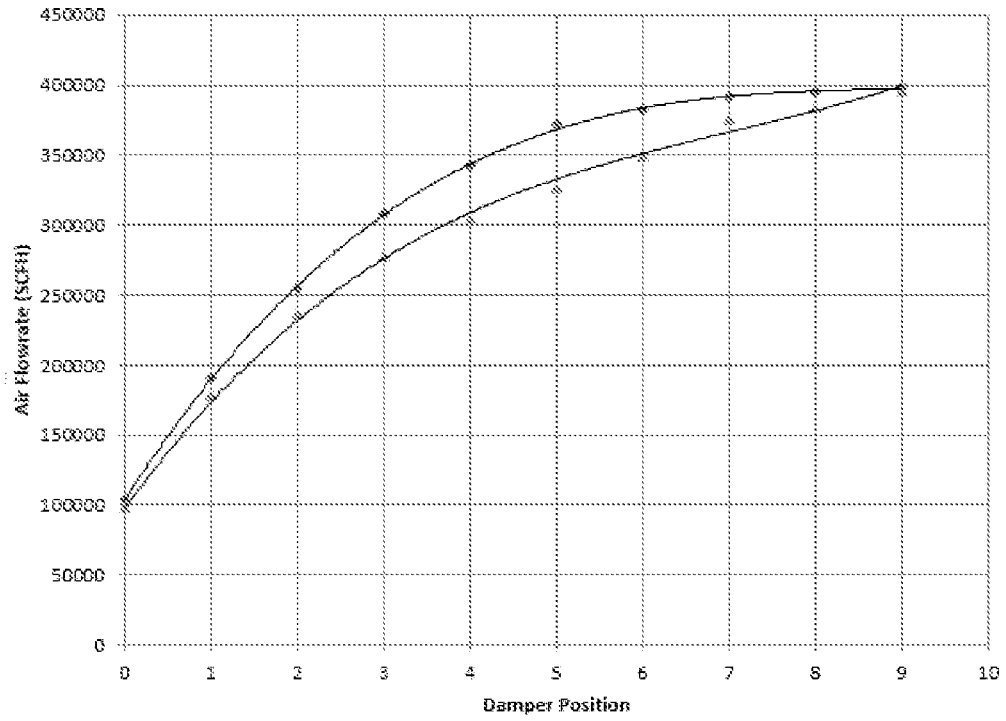
FIG. 12 is a chart illustrating airflow rates versus damper position for a burner assembly with and without a blocking plate.

Typically, when comparing airflow to damper position, louvered dampers exhibit an airflow characteristic that is similar to a "quick open" valve, and airflow rate initially increases very rapidly as the damper is opened and then increases more slowly as the damper continues to be opened. This characteristic shape is illustrated, for example, in the upper curve in FIG. 12 (with data points denoted by diamond-shaped icons), which illustrates the air flowrates for a burner assembly that does not have a fan blocking plate at damper positions "0" thru "9." However, burners with fan blocking plate 144 exhibit an airflow characteristic that is much flatter and linear. This characteristic shape is illustrated, for example, in the lower curve (with data points denoted by triangle-shaped icons), which illustrates the air flowrates for an identical burner assembly having a fan blocking plate 144 at the same damper positions as above. In both cases, the flowrate ranges from about 100,000 standard cubic feet per hour (SCFH) to about 400,000 SCFH. When the burner assembly has no fan blocking plate, it achieves approximately 91% of its maximum flowrate range when the damper is at position "5." This provides only 5 damper positions for adjusting the flowrate downwards. On the other hand, when the burner assembly is equipped with a fan blocking plate, the flowrate curve is much flatter and the burner reaches approximately the same percentage of the maximum flowrate range (~93%) when the damper is at position "7." This provides a total of 7 damper positions for adjusting the flowrate downwards. Thus, a burner assembly equipped with a fan blocking plate according to the current invention has a greater amount of adjustability at low and mid-range airflow rates than an equivalent burner assembly that does not have a fan blocking plate. This adjustability enables a user to more easily obtain the desired airflow and to more precisely control the air-to-fuel ratio than in conventional burner systems.

Although this description contains many specifics, these should not be construed as limiting the scope of the invention but as merely providing illustrations of some of the presently preferred embodiments thereof, as well as the best mode contemplated by the inventor of carrying out the invention. The invention, as described and claimed herein, is susceptible to various modifications and adaptations as would be appreciated by those having ordinary skill in the art to which the invention relates.

What is claimed is:

1. A burner assembly comprising:

a housing having an air inlet and an air outlet and configured to guide an airflow from the air inlet and out of the housing via the air outlet; and an airflow restrictor plate for selectively restricting an amount of airflow passing out of the housing in order to adjust a heat output of the burner assembly, the airflow restrictor plate having an a single opening through which all airflow flowing through the housing from the air inlet must pass in order to exit the housing via the air outlet, wherein the airflow restrictor plate is configured to be selectively removed from within the housing.

2. The burner assembly of claim 1 wherein the opening of the airflow restrictor plate is substantially centered within the housing when the airflow restrictor is mounted to the housing and wherein a portion of the airflow is redirected by the airflow restrictor away from an inner wall surface of the housing and towards a center of the housing and then through the opening in the airflow restrictor plate before exiting via the air outlet.

3. The burner assembly of claim 1 wherein the housing comprises:

a first tubular housing portion; and a second tubular housing portion, wherein the airflow restrictor plate is removably mounted between the first and second tubular housing portions, and wherein the airflow flows from the first tubular housing portion into the second tubular housing portion via the opening in the airflow restrictor.

4. The burner assembly of claim 3 wherein the first tubular housing portion has a first inner wall surface with a first diameter, the second tubular housing portion has a second inner wall surface with a second diameter, and the opening of airflow restrictor has a third diameter that is smaller than the first diameter and second diameter.

5. The burner assembly of claim 3 comprising two or more interchangeable airflow restrictor plates that each have openings with different cross-sectional areas, such that airflow through the housing may be varied by replacing one of the two or more airflow restrictor plates with another one of the two or more airflow restrictor plates.

6. The burner assembly of claim 1 further comprising fasteners configured to pass through aligned openings formed in perimeter flanges formed on each of the first tubular housing, second tubular housing, and airflow restrictor plate.

7. The burner assembly of claim 1 comprising two or more interchangeable airflow restrictor plates that each have a single opening with a different cross-sectional area through which the airflow must pass and that provides different degrees of restriction to the airflow based on the cross-sectional area of the opening.

8. The burner assembly of claim 7 wherein the opening of each of the airflow restrictor plates is circular in shape.

9. The burner assembly of claim 1 wherein the size of the opening in the airflow restrictor plate may be selectively adjusted to provide two or more different cross-sectional areas.

10. The burner assembly of claim 1 further comprising:

a fuel supply line extending along an outer surface of the housing and configured to provide fuel proximate the air outlet; and a cutout formed in the airflow restrictor plate configured to receive the fuel supply line.

11. The burner assembly of claim 1 further comprising an:

an inline centrifugal fan for generating the airflow;

a motor for powering the fan; and a damper for modulating the airflow having an inlet side that is disposed at an outlet of the fan that the airflow flows into and an outlet side that the airflow exits out of.

12. The burner assembly of claim 1 further comprising a fan blocking plate removably located adjacent the outlet side of the damper and configured to block a portion of the airflow exiting the damper.

13. The burner assembly of claim 12 wherein the fan blocking plate is circular in shape and has a center that is located concentric with a center of rotation of the fan.

14. The burner assembly of claim 12 wherein the fan blocking plate is formed by two semi-circular halves that each have a flat side such that, when the flat sides are placed adjacent one another, a fan blocking plate that is circular in shape is formed and a center of the circular fan blocking plate is located concentric with a center of rotation of the fan.

15. A method for adjusting the heat output of a fuel burner assembly, which fuel burner assembly has a housing with an air inlet provided in a first tubular housing portion, an air outlet provided in a second tubular housing portion, wherein an airflow is guided by the housing from the air inlet, through the first housing portion and second housing portion, and out of the housing via the air outlet, the method comprising the steps of:

providing said fuel burner assembly; and removably locating a first airflow restrictor plate having an opening with a first cross-sectional area between the first and second tubular housing portions of the housing such that all of the airflow passes from the first housing portion to the second housing portion exclusively via the opening and, as a result of passing through the opening, the airflow experiences a first degree of restriction which results in a first heat output from the fuel burner assembly.

16. The method of claim 15 further comprising the steps of:

removing the first airflow restrictor plate from between the first and second tubular housing portions; and removably locating a second airflow restrictor plate having an opening with a second cross-sectional area between the first and second tubular housing portions of the housing such that all of the airflow passes from the first housing portion to the second housing portion exclusively via the opening and, as a result of passing through the opening, the airflow experiences a second degree of restriction which results in a second heat output from the fuel burner assembly.

17. A burner assembly comprising:

a housing having an air inlet and an air outlet and configured to guide an airflow from the air inlet and out of the housing via the air outlet;

an airflow restrictor plate having a central opening through which said airflow passes, the airflow restrictor plate configured to restrict said airflow in order to adjust a heat output of the burner assembly, wherein the airflow restrictor plate is configured to be selectively removed from within the housing; and air and fuel lines configured to carry air and fuel, separately and unmixed, through the central opening of the airflow restrictor plate, wherein the air and fuel are configured to be mixed downstream from the central opening prior to being combusted.

* * * * *